US010520143B1

(12) United States Patent
Findlay et al.

(10) Patent No.: US 10,520,143 B1
(45) Date of Patent: Dec. 31, 2019

(54) LED SIMULATED NEON WITH STRUCTURAL REINFORCEMENT

(71) Applicant: Elemental LED, Inc., Reno, NV (US)

(72) Inventors: Alexander L. Findlay, Bournemouth (GB); Travis Irons, Reno, NV (US); Randall Holleschau, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 16/373,091

(22) Filed: Apr. 2, 2019

Related U.S. Application Data

(60) Provisional application No. 62/823,753, filed on Mar. 26, 2019.

(51) Int. Cl.

| | |
|---|---|
| ***F21S 4/00*** | (2016.01) |
| ***F21S 4/22*** | (2016.01) |
| *F21Y 103/10* | (2016.01) |
| *F21Y 115/10* | (2016.01) |

(52) U.S. Cl.
CPC ..... *F21S 4/22* (2016.01); *F21Y 2103/10* (2016.08); *F21Y 2115/10* (2016.08)

(58) Field of Classification Search
CPC ..... F21Y 2103/003; F21S 4/003; F21S 4/005; F21S 4/006; F21S 4/007; F21S 4/22
USPC ..... 362/223
See application file for complete search history.

(56) References Cited

U.S. PATENT DOCUMENTS

| | | | | |
|---|---|---|---|---|
| 8,322,883 | B2 * | 12/2012 | Cleaver | F21K 9/00 362/249.02 |
| 9,113,558 | B2 | 8/2015 | Baik | |
| 9,115,858 | B2 * | 8/2015 | Levante | F21V 23/06 |
| 9,601,866 | B1 | 3/2017 | Petersen et al. | |
| 2002/0071276 | A1 * | 6/2002 | Blum | F21V 19/00 362/249.07 |
| 2005/0231947 | A1 * | 10/2005 | Sloan | F21V 21/005 362/235 |
| 2015/0354797 | A1 * | 12/2015 | Luo | H05K 1/028 362/223 |

OTHER PUBLICATIONS

Elemental LED, Inc. "Neon Blaze(TM) 24V LED Strip Light: Side Emitting Strip Light Specification Sheet." Version of Mar. 2019.
Elemental LED, Inc. "Neon Blaze(TM) 24V LED Strip Light: Top Emitting Strip Light Specification Sheet." Version of Mar. 2019.

* cited by examiner

*Primary Examiner* — Matthew J. Peerce
(74) *Attorney, Agent, or Firm* — United IP Counselors, LLC

(57) ABSTRACT

LED simulated neon with a reinforcing member is disclosed. The simulated neon has a flexible covering with a translucent upper portion and an opaque lower portion. At least the lower portion is filled with a transparent, flexible material. A channel is formed in the transparent, flexible material. Linear lighting is provided in the channel, along with a reinforcing member. The reinforcing member is shaped and oriented such that it can bend in the primary bending plane of the simulated neon but provides strain relief and at least partially restricts or interferes with bending in other planes. The reinforcing member may, for example, have a rectangular cross-section, wider than it is thick. It may be made of plastic or metal, and its thickness may vary depending on the material of which it is made.

10 Claims, 3 Drawing Sheets

LED SIMULATED NEON WITH STRUCTURAL REINFORCEMENT

CROSS-REFERENCE TO RELATED APPLICATIONS

This application claims priority to U.S. Patent Application No. 62/823,753, filed Mar. 26, 2019, the contents of which are incorporated by reference in their entirety.

BACKGROUND

1. Technical Field

The invention relates to linear LED lighting, and in particular, to simulated LED neon with structural reinforcement.

2. Related Art

Linear lighting is a term that describes a broad range of lighting products in which LED light engines are arranged at a regular pitch on a long, thin printed circuit board (PCB). Linear lighting may be made in arbitrarily long lengths by joining shorter strips of PCB together, usually by soldering. The PCB is laid out electrically so that it can be cut at regularly-spaced cut points. In some cases, adhesive, such as pressure-sensitive adhesive, may be applied to the reverse of the PCB, so that the linear lighting can be physically adhered to a surface. Linear lighting with adhesive on the reverse is often referred to as "tape light."

In linear lighting, the PCB may be either rigid or flexible. "Flexible" PCB is usually flexible in a single plane. Bending in other planes may damage the PCB, as may bending the PCB too much even in the intended bending plane. Linear lighting with a PCB that can be flexed in multiple planes is known, e.g., as disclosed in U.S. Pat. No. 9,113,558; however, PCB that is flexible in multiple planes usually has a reduced current carrying capacity relative to single-plane flexible lighting, which can result in shorter maximum lengths and less emitted light.

Flexible PCB is particularly common in linear lighting, mainly because it allows for easier installation—for example, an extremely long length of linear lighting may be wound around a spool, cut to a desired length in the field, and installed. While a flexible PCB can bend and conform to a surface, most conventional flexible linear lighting is installed in straight lines, with minimal or no bend in the final installation.

In the last few years, LED simulated neon has come onto the market. Simulated neon is a different form of linear lighting that usually includes a flexible PCB with LED light engines encased within an extrusion or other type of casing, such as a soft silicone or polyurethane extrusion. The casing is usually shaped, at least in part, to mimic the tubular shape of traditional neon. The LED light engines within the casing may be white-light emitting, colored-light emitting, RGB light engines that can emit a variety of colors, RGBW light engines that can emit a variety of colors and also have a dedicated white-light LED, or tunable white light engines that can emit a variety of color temperatures of white light. The extrusion or casing diffuses the light from the LED light engines, so that the product provides a light output similar to neon when lit.

LED simulated neon is intended to be bent when installed. Traditional neon lighting is a type of gas-discharge lamp made with flame-bent glass tubing, and simulated neon is intended to mimic the tight bends and intricately curved features that are possible with traditional neon. However, such tight bends can stress the PCB and cause failures, either during installation or over the life of the product.

SUMMARY OF THE INVENTION

One aspect of the invention relates to LED simulated neon with a reinforcing member that provides strain relief to the linear lighting within the simulated neon. More specifically, the simulated neon has a flexible covering with a translucent upper portion and an opaque lower portion. At least the lower portion is filled with a transparent, flexible material. A channel is formed in the transparent, flexible material. Linear lighting is provided in the channel, along with a reinforcing member. The reinforcing member is shaped and oriented such that it can bend in the primary bending plane of the simulated neon but at least partially restricts or interferes with bending in other planes.

The reinforcing member may, for example, have a rectangular cross-section, wider than it is thick. It may be made of plastic or metal, and its thickness may vary depending on the material of which it is made. If made of metal, the reinforcing member may be either resilient under the expected forces, or it may be malleable, retaining its shape when bent.

Other aspects of the invention relate to reinforcing members of other shapes and configurations. For example, the reinforcing member may have the shape of a channel, with a bottom and sidewalls.

These and other aspects, features, and advantages of the invention will be set forth in the description that follows.

BRIEF DESCRIPTION OF THE DRAWING FIGURES

The invention will be described with respect to the following drawing figures, in which like numerals represent like features throughout the figures, and in which.

DETAILED DESCRIPTION

Figure 1:
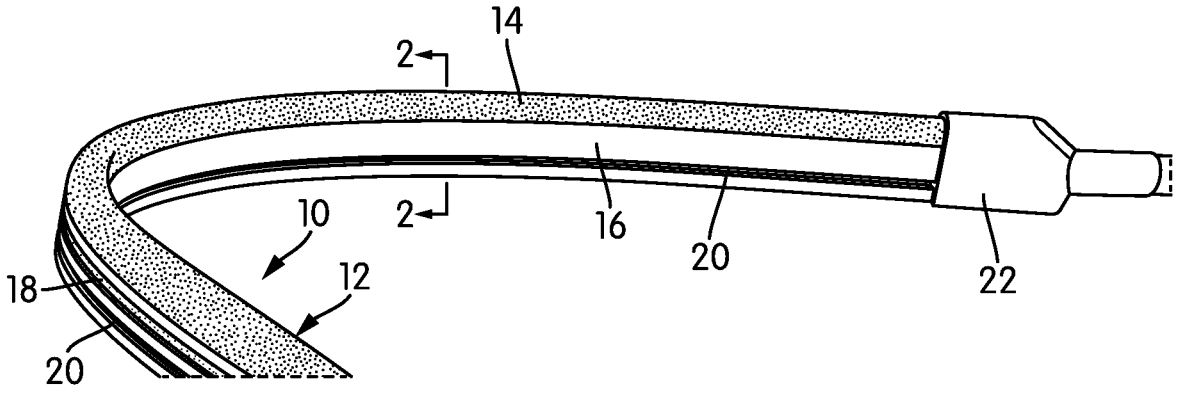
FIG. 1 is a perspective view of a strip of side-bend LED simulated neon according to one embodiment of the invention.

FIG. 1 is a perspective view of a strip of side-bend LED simulated neon, generally indicated at 10, according to one embodiment of the invention. As used here, the term "side bend" refers to the fact that the neon bends in a single plane that is perpendicular to a line normal to its top and bottom surfaces. FIG. 1 illustrates the linear lighting 10 bent in its bending plane. Bending in other planes may damage the simulated neon 10.

The exterior or covering 12 of the simulated neon 10 comprises an upper portion 14 that is at least translucent and a lower portion or base 16 that is opaque in the illustrated embodiment. The base 16 may be made opaque with a white or other light-reflective colorant. The upper portion 14 is at least semi-cylindrical in shape and, generally speaking, is shaped to resemble the small glass tube used in traditional neon. To facilitate mounting, the base 16 is squared-off and generally rectangular in cross-sectional shape, although it may have rounded corners and need not be rectangular in all embodiments.

Like many other forms of linear lighting, the simulated neon 10 is constructed and arranged to allow it to be cut to a desired length. Depending on the embodiment and the application, that cutting may occur in the field, it may occur in the factory, or it may occur on the premises of an authorized seller, reseller, or system integrator. As was described above, linear lighting is usually arranged electrically and mechanically so that it can be cut at specific cut points without compromising any circuits. For these reasons, in some embodiments, the simulated neon 10 may have exterior markings, such as tick marks, illustrating those cut points, i.e., where it can be cut without compromising any circuits. In other embodiments, these markings may be on a PCB within the covering 12. For that reason, the covering 12 has a thin, transparent stripe 18 on one side that allows direct visualization of the underside of the PCB within the covering 12. Markings on the PCB illustrate the cut points. Additionally, a pair of aligned grooves 20, one on each side of the base 16 close to its bottom, allows for the use of mounting clips and other such mounting hardware.

The covering 12 itself is made of a flexible rubber, such as a soft silicone rubber or polyurethane rubber, that can comfortably bend to relatively tight radii. Depending on the embodiment, the same material may be used with different colorants or other additives to form the translucent upper portion 14, the opaque base 16 and, if one is present, the transparent stripe 18. The covering 12 and its various parts 14, 16, 18 may be extruded, either as a co-extrusion in a single stage or in multiple steps or stages. However, extrusion is not the only process that can be used to make the covering 12. For example, the covering 12 may be made by casting a resin into a mold. For example, a two-part polyurethane resin could be cast in a series of steps into a silicone mold.

The simulated neon 10 may accept any type of power, either alternating current (AC) or direct current (DC) with any voltage or other characteristics. The operating voltage may be either high voltage or low voltage. (The definitions of "high voltage" and "low voltage" vary somewhat depending on the authority one consults, but for purposes of this description, "high voltage" should be defined as any voltage over about 50V.) As those of skill in the art will understand, the length of the simulated neon 10 may be electrically limited by the inherent resistance of the conductors, the starting voltage, and other such factors. Regulatory limits may also limit the length of the simulated neon 10, primarily by limiting the amount of power that a single strip of simulated neon 10 can draw. For example, to qualify as a "Class 2" device under the electrical code of the United States—a designation that affects certain safety requirements—a device may draw no more than 60 W with an operating voltage of 12V, or 96 W with an operating voltage of 24V. A power connector 22 is shown attached to one end of the simulated neon 10.

Generally speaking, the power and efficacy (i.e., light output per watt of input power) considerations for the simulated neon 10 are the same as for other forms of linear lighting. However, there are some additional considerations specific to simulated neon 10. For example, while the covering 12, and particularly its upper portion 14, preferably provides an even, fully-diffused appearance to the emitted light, the material and thickness of the upper portion 14, the distances between the LED light engines and the covering 12, and other design factors should be selected so as not to unduly reduce the efficacy of the simulated neon 10. In other words, the simulated neon 10 should be designed so that as much light is emitted as possible per watt of input power.

Figure 2:
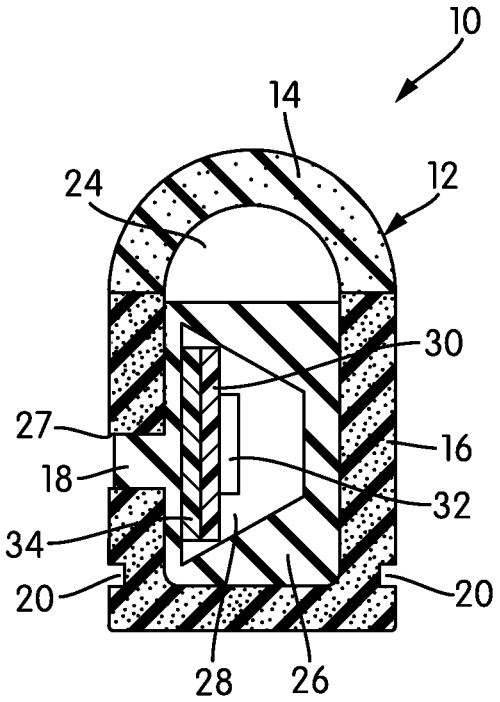
FIG. 2 is a cross-sectional view of the strip of simulated neon, taken through Line 2-2 of FIG. 1.

FIG. 2 is a cross-sectional view of the simulated neon, taken through Line 2-2 of FIG. 1. As shown, the rounded upper portion 14 is hollow, leaving an air gap 24 between the upper portion 14 and the base 16. The upper and lower portions 14, 16 are connected. The opaque base 16 is at least partially filled with a transparent rubber 26, which may be the same material of which the upper portion 14 and the base 16 are made without translucent or color additives. There is a break 27 in the mid-sidewall of the base 14; the transparent rubber 26 fills the break to create the transparent stripe 18 that allows visibility into the interior of the base 16.

A channel 28 is formed within the center of the transparent rubber 26 that fills the base 16. The channel 28 is offset from center, such that the channel 28 of the illustrated embodiment is closer to one sidewall of the base 14 than the other.

A strip of linear lighting 30 is mounted within the channel 28. The linear lighting 30 is mounted on its side, such that the reverse of the PCB rests against the sidewall of the channel 28. This mounting allows the bend-plane of the PCB to align with the desired bend-plane of the simulated neon 10. The LED light engines 32 emit light toward the other sidewall of the base 16. The opaque, reflective white sidewalls of the base 16 reflect the emitted light, and most of the emitted light ultimately travels upward, where it is released through the upper portion 14. Notably, the channel 28 is wider than the linear lighting 30, such that an air gap exists between the LED light engines 32 and the edge of the channel 28. The air gap in the channel 28 and the air gap 24 between the upper and lower portions refract light as it moves through the interface between rubber and air, causing the light to diffuse. Other aspects of the design of the covering 12 also work to diffuse the light. If the base 16 is not white, reflective layers within the base 16 may be provided in order to reflect and direct the light emitted from the linear lighting 30. The light engines 32 may be of any of the types described above.

The channel 28 of FIG. 2 is generally trapezoidal in overall shape, but there are no particular restrictions on its shape so long as it has sufficient width and height to accommodate the linear lighting 30 and other components that will be described below.

When the simulated neon 10 is installed, it may be subjected to significant bending, as was explained above. While the covering 12 may provide some strain relief, the linear lighting 30 within the simulated neon 10 will be subjected to at least some of the same bending stresses as the simulated neon 10.

For that reason, the simulated neon 10 contains a reinforcing member 34. In the illustrated embodiment, the reinforcing member 34 is located between the underside of the linear lighting 30 and the sidewall of the channel 28 against which the linear lighting 30 is mounted. However, other positions and arrangements are possible. The reinforcing member 34 is a wide, flat strip. It may be the same width as the linear lighting 30, or it may be slightly wider than the linear lighting 30 itself, e.g., 0.2-0.4 mm wider than the linear lighting 30. Generally speaking, the reinforcing member 34 is present to provide additional strain relief to the linear lighting 30. In some cases, it may also prevent, restrict, or limit bending in planes other than the intended bending plane.

In most embodiments, the reinforcing member 34 will be between 8-14 mm in width and may be between about 0.25 mm and 3 mm in thickness, although thicknesses of at least 0.18 mm may be used in some embodiments. The reinforcing member 34 is preferably stiffer than the material of which the coating 12 is made, and may be as stiff or stiffer than the linear lighting 30 itself "Stiffness," as the term is used here, is a function of at least the elastic or bending modulus of the reinforcing member 34, as well as the cross-sectional shape and resulting moments of area of the reinforcing member 34. In other words, the stiffness of the reinforcing member as a whole is a function of the inherent elasticity or rigidity of the material and how that material is distributed relative to the bending plane. Other factors may contribute to stiffness as well. Reinforcing members 34 that are more flexible may be thicker in section; reinforcing members 34 that are more rigid may be thinner.

Any number of different plastics may be used to form the reinforcing member 34 including polyesters, acrylonitrile-butadiene-styrene (ABS) plastics, polyamides, polyimides, polycarbonates, and polyvinylchloride (PVC), to name a few. As one example, polyethylene terephthalate (PET) may be a particularly suitable material for reinforcing member 34, as it is widely available, easily processed, and has a relatively high elastic modulus for a plastic. If the simulated neon 10 has a transparent slit 20 in its covering 12, it may also be helpful if the reinforcing member 34 is also transparent, so that the PCB of the linear lighting can be visualized. Alternatively, any necessary or desirable markings could be placed on the reinforcing member 34.

In addition to plastics, any number of metals could be used in a reinforcing member 34. For example, the reinforcing member 34 may be a steel, aluminum, or copper ribbon. Because of their greater stiffnesses, metals would typically be used in thinner section than plastics. If a metal is used, the metal may be engineered so as to be either resilient or malleable. If the metal is malleable—i.e., it has a shape and other characteristics that allow it to deform plastically under manual pressure and remain in the position or shape that is imparted to it—that could be useful in helping to shape the simulated neon during installation. In that case, fewer mounting clips may be needed in order to keep the simulated neon 10 in the desired position.

The reinforcing member 34 may be attached to the linear lighting 30, it may be attached to the interior of the covering 12, it may be attached to both structures 12, 30, or it may be completely unattached. If the reinforcing member 34 is attached to any structure, it may be by means of a layer or layers of pressure-sensitive adhesive applied over the entire length of the reinforcing member 34, or it may be by means of pressure-sensitive or other types of adhesive applied in particular spots.

The position of the reinforcing member 34 may also vary from embodiment to embodiment. In the embodiment of FIG. 2, the reinforcing member 34 is located between the linear lighting 30 and the channel 28. The reinforcing member 34 may alternatively be located along the opposite wall of the channel 28. Generally speaking, the reinforcing member 34 can be located anywhere that allows it to bend in the bending plane of the simulated neon 10.

One advantage of the position of the reinforcing member 34 that is shown in FIG. 2 is that the reinforcing member 34 can be inserted into the simulated neon 10 after the covering 12 is formed. In fact, if the reinforcing member 34 is made of a low-friction plastic, the presence of the reinforcing member 34 may make it easier to insert the linear lighting 30. However, in some embodiments, a reinforcing member 34 could be embedded in the covering 12, either in the sidewall, the bottom, or in the transparent rubber 26 that forms the channel 28.

Figure 3:
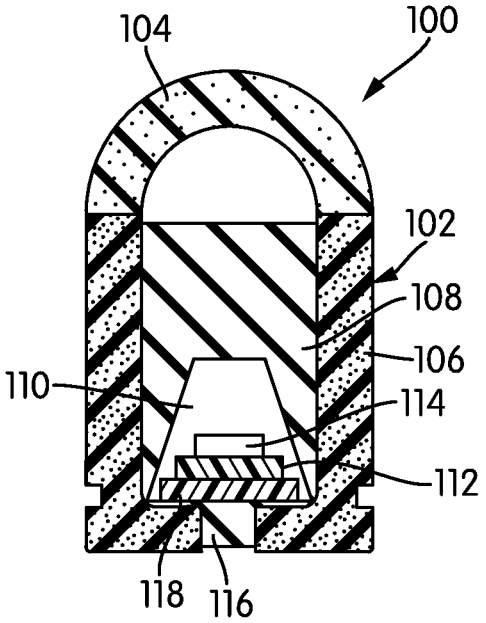
FIG. 3 is a cross-sectional view of a strip of simulated neon according to another embodiment of the invention.
Figure 4:
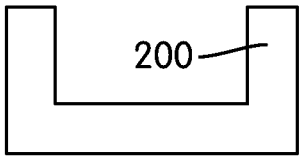
FIGS. 4-7 are end-elevational views of reinforcing members for simulated neon according to other embodiments of the invention.
Figure 5:
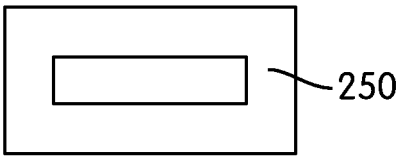
Figure 6:
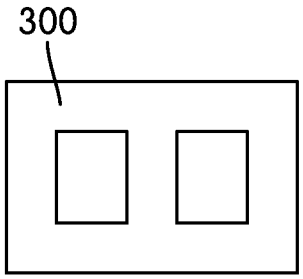
Figure 7:
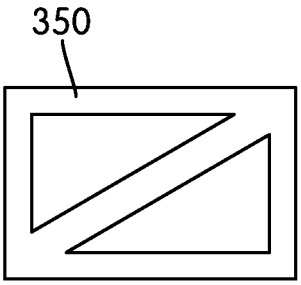

As those of skill in the art will appreciate, simulated neon with other intended bending planes may be made. FIG. 3 is a cross-sectional view similar to FIG. 2, illustrating simulated neon, generally indicated at 100, according to another embodiment of the invention. Like the embodiment described above, the simulated neon 100 has a covering 102 that is divided into an upper portion 104 and a lower portion 106 or base. The upper portion 104 is translucent and constructed to diffuse and to emit light. Like the upper portion 14, the upper portion 104 is at least semi-cylindrical and is intended to mimic the thin tube of conventional neon. A transparent rubber 108 fills at least the lower portion of the simulated neon 100, with a channel 110 formed within the transparent rubber 108. The primary difference between the "side bend" simulated neon 10 and the "top bend" simulated neon 100 lies in the orientation of the channel 110, and the linear lighting 112 within the channel 110. The rear of the linear lighting 112 faces the bottom of the base 106, rather than one of its sidewalls, such that the LED light engines 114 emit light directly at the upper portion 104. A transparent slit 116 is formed in the bottom of the base 106, filled with the transparent rubber 108. The simulated neon 100 bends in a plane that is parallel to a line normal to the top and bottom surfaces of the simulated neon 100 and bisects the simulated neon 100 longitudinally. In other words, the simulated neon 100 bends up and down with respect to the coordinate system of FIG. 3.

A reinforcing member 118 is interposed between the linear lighting 112 and the bottom of the base 106. The reinforcing member 118 may be made of any of the materials described above, and may have any thickness or shape. For example, the reinforcing member 118 may be a 0.25 mm thick strip of PET.

In FIGS. 2 and 3, the reinforcing member 34, 118 has a thin, flat cross-sectional shape. However, that need not be the case in all embodiments. FIGS. 4-7 illustrate other potential cross-sectional shapes for the reinforcing member, including the U- or C-shaped channel 200 of FIG. 4; the hollow member 250 of FIG. 5; and the truss/girder members of FIGS. 6 and 7. When selecting a shape for a reinforcing member, relevant factors include the amount of space available within the simulated neon, the level of strain relief or bending resistance that is required, and the nature of the forces that are likely to be encountered. If the reinforcing member forms a channel, like the reinforcing member 200 of FIG. 4, or the member is hollow, like the reinforcing member 250 of FIG. 5, the linear lighting may be placed inside it.

The simulated neon 10, 100 may be connected to power in any number of ways. One way of connecting the simulated neon 10, 100 to power is to solder power connectors directly to the linear lighting 30, 112, usually to solder pads on the top of the PCB. Soldering is reliable, but requires equipment and practice; done incorrectly, it can damage the linear lighting 30, 112. For that reason, simulated neon 10, 100 may be connected to power by a specialized, pronged connector that slides under the linear lighting 30, 112 and makes electrical contact with conductive pads on the reverse of the PCB. The manner in which the simulated neon 10, 100 is connected to power is not critical, but it may affect the positioning and other characteristics of the reinforcing member 34, 118. For example, if the reinforcing member 34, 118 is under or behind the linear lighting 30, 112, it may be helpful if the reinforcing member 34, 118 is not attached to the linear lighting 30, 112, or is only partially attached, so that a connector can be inserted between the linear lighting 30, 112 and the reinforcing member 34, 118.

Figure 8:
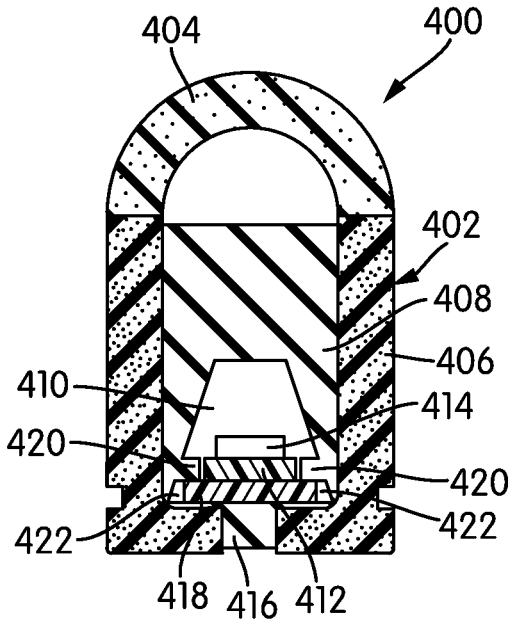
FIG. 8 is a cross-sectional view of a strip of simulated neon that includes constraining or positioning features for a reinforcing member, according to yet another embodiment of the invention.

In the linear lighting 10, 100 described above, the reinforcing member 34, 118 is free-floating and can flex and move relative to the other components. That need not be the case in all embodiments. FIG. 8 is a cross-sectional view of a strip of simulated neon, generally indicated at 400, that includes structure to fix or constrain the position of a reinforcing member. The overall structure of simulated neon 400 is very similar to structure of simulated neon 300 of FIG. 8.

More specifically, the simulated neon 400 has a covering 402 that is divided into an upper portion 404 and a lower portion 406 or base. The upper portion 404 is translucent and constructed to diffuse and to emit light. The upper portion 404 is at least semi-cylindrical and is intended to mimic the thin tube of conventional neon. A transparent rubber 408 fills at least the lower portion of the simulated neon 400, with a channel 410 formed within the transparent rubber 408. The rear of the linear lighting 412 faces the bottom of the base 406, rather than one of its sidewalls, such that the LED light engines 414 emit light directly at the upper portion 404. A transparent slit 416 is formed in the bottom of the base 406, filled with the transparent rubber 408.

In the simulated neon 400, a pair of projections 420 extend from opposite sidewalls of the channel 410, forming slots 422 between the base of the channel 410 and the projections 420 on each side of the channel 410. The slots 422 accommodate the reinforcing member 418, such that the projections 420 hold the reinforcing member 418 in place or, at least, constrain its movement relative to the other components. FIG. 8 illustrates but one example of this principle; slots and the grooves or projections that create them may be positioned essentially anywhere. The reinforcing member 418 may move freely within the slots 422, or it may be fixed in place within them. Moreover, while the slots 422 are defined by projections, in some cases, a continuous divider may be formed or provided in the channel 410, forming a separate channel for the reinforcing member 418. As those of skill in the art will appreciate, the principle of using a channel or other, similar features to constrain the movement of a reinforcing member is equally applicable to a side-bend configuration, like that of FIGS. 1-2.

As was described above, the simulated neon 10, 100, 400 described above has two air gaps, one in the base, between the linear lighting and the channel that contains it, and a second air gap between the base and the upper portion. While these air gaps may have some refractive effect and assist in diffusing the light, they are not necessary in all embodiments. Encapsulated linear lighting with fewer air gaps or no air gaps may be made with a reinforcing member, and that encapsulated linear lighting may or may not have the same cross-sectional shape as the simulated neon 10, 100, 400 described above.

Figure 9:
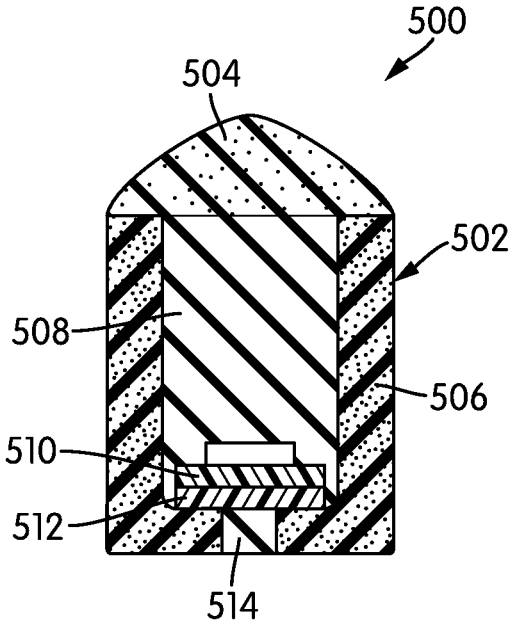
FIG. 9 is a cross-sectional view of a strip of simulated neon according to a further embodiment of the invention.

FIG. 9 is a cross-sectional view of "top bend" encapsulated linear lighting, generally indicated at 500, according to a further embodiment of the invention. As those of skill in the art will understand, the distinction between simulated neon and the more general category of encapsulated linear lighting is sometimes not a firm one. For purposes of this description, all simulated neon is a type of encapsulated linear lighting, in that the raw linear lighting is contained within a covering. Whether a piece of encapsulated linear lighting is simulated neon depends, at least in part, on its shape, especially of the uppermost portion; the type of LED light engines used within it; and the use to which it is put.

Encapsulated linear lighting 500 has an encapsulation or covering 502 with an upper portion 504 and a lower portion or base 506. The covering 502 is typically flexible, but may be either more or less flexible than the simulated neon 10, 100, 400 described above. In the encapsulated linear lighting 500, there is no air gap between the upper portion 504 and the base 506. The upper portion 504 of FIG. 9 is a rounded portion that lies directly overtop the base 506. The base 506 comprises a sidewall and bottom that are typically made in a reflective white. The base 506 may be filled with a layer or layers of transparent or translucent plastic or rubber 508, leaving no air gap between the rubber 508 and the linear lighting 510 that is disposed at the bottom of the base 506. A reinforcing member 512 is disposed under the linear lighting 510. Either the top portion 504 or a layer of the rubber 508 within the base may be made with a translucent additive in order to assist in light diffusion. A transparent strip 514 in the bottom of the base 506 allows visualization of the underside of the linear lighting 510, in order to allow visualization of markings indicating cut points.

Typically, the encapsulated linear lighting 500 would be made by forming the outer shell of the base 506, installing the reinforcing member 512 and the linear lighting 510 in the base 506, and then filling the base 506. That filling may be done in a single dose or layer, or it may be done in multiple doses or layers. As was described briefly above, layers of transparent material may be interposed between a layer or layers of translucent material. The upper portion 504 may simply comprise the meniscus that occurs when the base 506 is filled, or steps may be taken to shape it as shown in FIG. 9. (The upper portion 504 of FIG. 9 is rounded but not hemispherical.) As was noted briefly above, the resins that are used in the process may single-part or two-part polyurethanes or silicones.

The reinforcing member 512 may have the same properties and be made of the same materials as the reinforcing members 34, 118, 418 described above. The only potential additional consideration in encapsulated linear lighting 500 is whether the material of which the reinforcing member 512 is made is compatible with the resins that are used, since the reinforcing member 512 will be encapsulated in the resins.

The encapsulated linear lighting 500 of FIG. 9 is "top bend." However, "side bend" linear lighting could be made in accordance with the principles described above.

While the invention has been described with respect to certain embodiments, the description is intended to be exemplary, rather than limiting. Modifications and changes may be made within the scope of the invention, which is defined by the appended claims.

What is claimed is:

1. A linear lighting device, comprising:

a flexible covering having a translucent upper portion and an opaque lower portion;

a transparent filling disposed within the lower portion;

a channel within the transparent filling;

a strip of flexible linear lighting disposed within the channel, the strip of flexible linear lighting having at least one bending plane and at least one more rigid plane;

a resilient reinforcing member disposed within the channel and extending in parallel with the strip of flexible linear lighting, the reinforcing member being constructed and arranged to bend in the at least one bending plane and to restrict bending in the at least one more rigid plane, and having a rectangular cross-section, wider than it is thick; and a transparent stripe in a side of bottom face of the opaque lower portion of the covering, the strip of flexible linear lighting arranged in the channel so that an underside of the strip of flexible linear lighting is visible through the transparent stripe;

wherein the reinforcing member is transparent and is positioned in the channel between the underside of the strip of flexible linear lighting and the transparent stripe.

2. The linear lighting device of claim 1, wherein the strip of flexible linear lighting is arranged within the channel such that the at least one bending plane is perpendicular to a line normal to top and bottom surfaces of the linear lighting.

3. The linear lighting device of claim 1, wherein the strip of flexible linear lighting is arranged within the channel such that the at least one bending plane is aligned with a line normal to top and bottom surfaces of the linear lighting and bisects the linear lighting longitudinally.

4. The linear lighting device of claim 1, wherein the reinforcing member is at least as wide as the linear lighting.

5. The linear lighting device of claim 4, wherein the reinforcing member is wider than the linear lighting.

6. The linear lighting device of claim 4, wherein the reinforcing member is plastic.

7. The linear lighting device of claim 6, wherein the reinforcing member is polyethylene terephthalate (PET).

8. The linear lighting device of claim 7, wherein the reinforcing member has a thickness of at least 0.25 mm.

9. The linear lighting device of claim 4, wherein the reinforcing member is metal.

10. The linear lighting device of claim 9, wherein the metal is steel or copper.

* * * * *